United States Patent [19]

Ackley

[11] Patent Number: 5,017,168

[45] Date of Patent: May 21, 1991

[54] COUNTER-ROTATING BOAT PROPELLER DRIVE

[76] Inventor: William V. Ackley, 2423 Norfolk Rd., Orlando, Fla. 32803

[21] Appl. No.: 492,975

[22] Filed: Mar. 12, 1990

[51] Int. Cl.[5] ..... B63H 5/10

[52] U.S. Cl. ..... 440/82; 440/79; 416/129

[58] Field of Search ..... 440/78–83, 440/112; 416/128, 129 R, 129 A, 170 R, 124, 127

[56] References Cited

U.S. PATENT DOCUMENTS

| | | | |
|---|---|---|---|
| 1,482,381 | 7/1918 | Cake | 416/129 A |
| 2,067,023 | 3/1936 | Schleicher | 416/129 R |
| 2,145,623 | 1/1939 | Hill | 440/77 |
| 2,704,991 | 3/1955 | Danielson | 440/82 X |
| 2,987,031 | 6/1961 | Odden | 440/81 |
| 3,167,361 | 1/1965 | Snapp et al. | 440/82 X |
| 4,050,849 | 9/1977 | Sheets | 416/171 |
| 4,304,557 | 12/1981 | Henrich | 440/78 X |
| 4,604,032 | 8/1986 | Brandt et al. | 416/128 |
| 4,710,142 | 12/1987 | Lovell | 440/82 X |
| 4,792,314 | 12/1988 | McCormick | 440/81 |

FOREIGN PATENT DOCUMENTS 3519103 12/1986 Fed. Rep. of Germany .

*Primary Examiner*—Ed Swinehart

*Attorney, Agent, or Firm*—St.Onge Steward Johnston & Reens

[57] ABSTRACT

A dual boat propeller structure is described for counter-rotation of the propellers. A housing is located outside the boat hull in alignment and connection with an engine shaft. The housing stores a conversion mechanism with which coaxially-mounted propeller shafts are brought into counter-rotation to correspondingly rotate the propellers. A strut interconnects the housing to the boat hull in a manner so as to reduce vibrations from the counter-rotating mechanism. The housing has a frusto-conical shape with which a large diameter aft end is sized commensurate with the hub of the propellers for smooth water flow.

10 Claims, 3 Drawing Sheets

FIG. 1
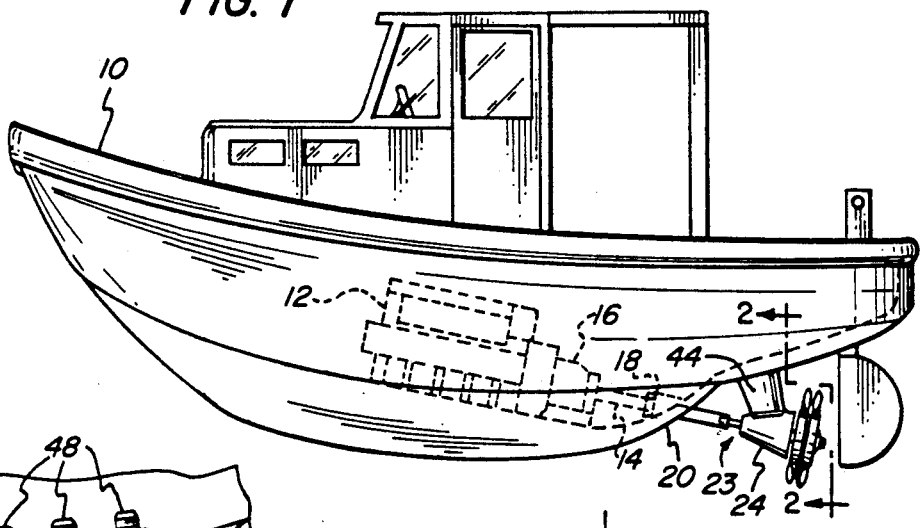
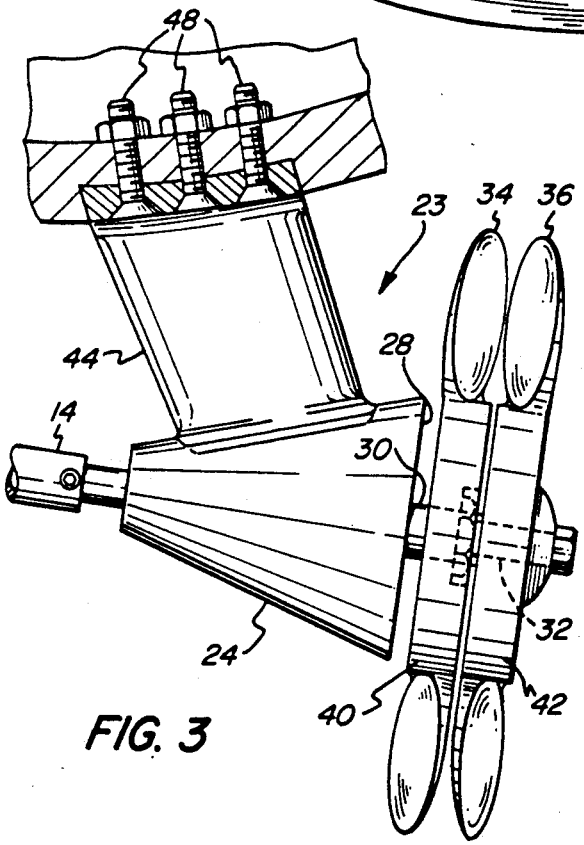
FIG. 3
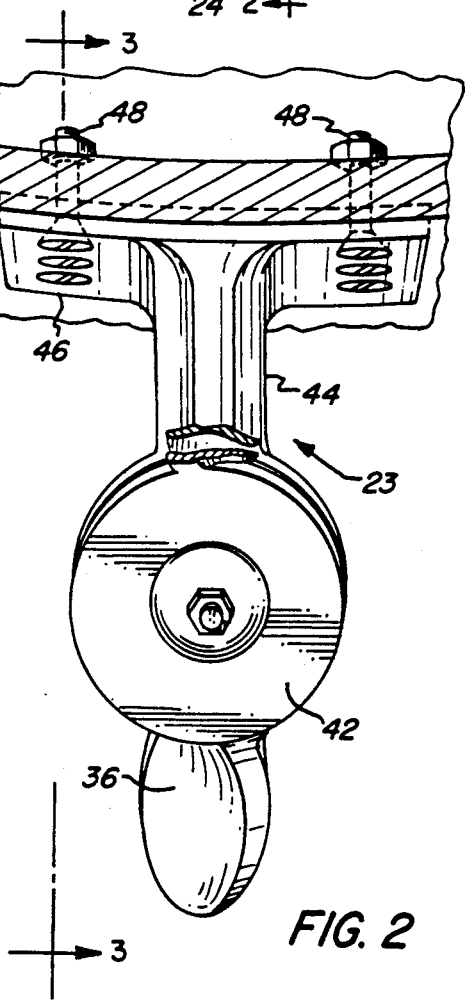
FIG. 2

COUNTER-ROTATING BOAT PROPELLER DRIVE

FIELD OF THE INVENTION

This invention relates to a boat propeller structure generally, and more specifically, to a propeller structure for counter-rotating propeller shafts.

BACKGROUND OF THE INVENTION

Counter-rotating propellers have been proposed for boats, see for example, U.S. Pat. No. 1,482,381 to Cake; U.S. Pat. No. 4,604,032 to Brandt et al.; U.S. Pat. No. 2,067,023 to Schleicher; and U.S. Pat. No. 4,792,314 to McCormick. However, those propeller systems propose a cantilevered-type mounting to the engine shaft. This tends to lead to excessive vibration and potential alignment problems. Streamlined struts that are connected to a boat hull for holding and supporting engine shaft cutlass bearings that are located below the boat hull and near the propeller are known in the art.

SUMMARY OF THE INVENTION

With a boat propeller structure in accordance with the invention, counter-rotating propellers are firmly supported so as to reduce vibrations from the mechanism that produces the counter rotation. This is achieved in one embodiment as described herein by employing a streamlined strut that is connected to the hull and the housing that encloses a mechanism that provides counter-rotating coaxially-mounted propeller shafts. The housing has a conical shape whose aft dimensions are approximately the same as the dimensions of the propeller hubs to facilitate the smooth flow of water past the housing during operation.

It is, therefore, an object of the invention to provide a stable support for a counter-rotating boat propeller structure with low vibration problems and a smooth water flow during operation.

This object and the advantages of the invention can be appreciated with reference to the following detailed description of an embodiment in accordance with the invention as shown in the drawings.

BRIEF DESCRIPTION OF DRAWINGS

FIG. 1 is a side view in elevation of an installed propeller structure in accordance with the invention;

FIG. 2 is an aft view of the propeller structure shown in FIG. 1 as taken along the lines 2—2 therein;

FIG. 3 is an enlarged side view in elevation and partial section of the propeller structure as shown in FIG. 1;

DETAILED DESCRIPTION OF DRAWINGS

Figure 4:
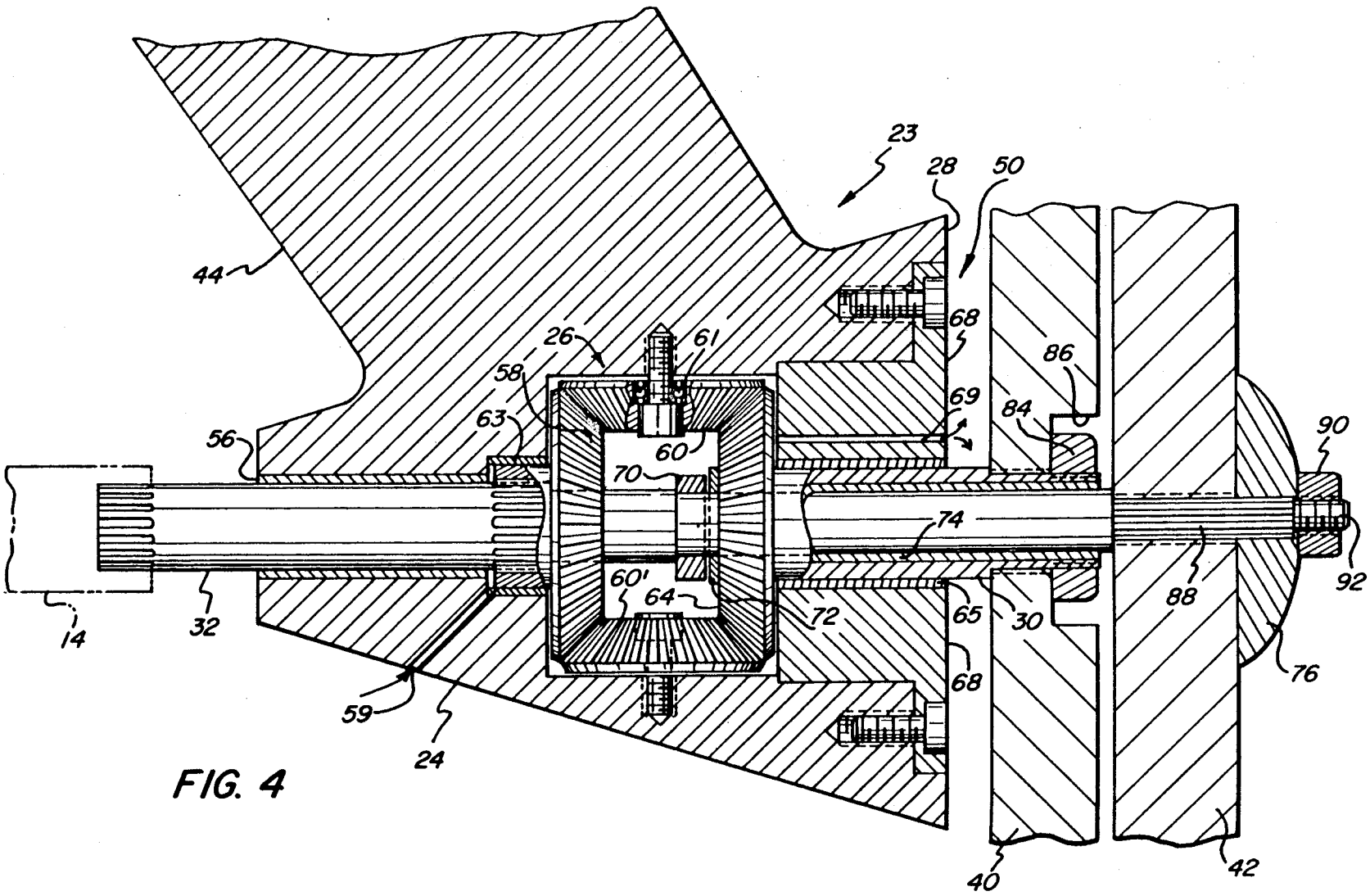
FIG. 4 is an enlarged section view of the propeller structure taken along a plane that intersects the engine shaft rotational axis.

With reference to FIGS. 1-3, a boat 10 is shown having an inboard engine 12 which causes rotation of a drive shaft 14 after a transmission 16 and a seal 18 that is located at the bottom 20 of the boat hull 22.

The drive shaft 14 is connected to a propeller structure 23 formed of a housing 24 in which a counter-rotation-producing mechanism 26 (see FIG. 4) is located. The housing 24 has a frusto-conical shape whose largest diameter end 28 is located at the aft end from where counter-rotating propeller shafts 30, 32 emerge. Propellers 34, 36 are respectively connected to propeller shafts 30, 32.

Propellers 34, 36 have cylindrical hubs 40, 42 whose diameters are generally the same or less than that of the housing end 28 so as to enable a smooth water flow during operation.

A strut 44 is used to support the housing 24. Strut 44 has a flange 46 that is affixed to the boat hull with suitable bolts 48. The strut 44 is affixed to the housing 24 by making the strut an integral part therewith or by attaching the strut 44 with suitable bolts or by welding. The strut 44 and housing 24 can be formed as a single casting.

Strut 44 has a streamlined shape with a width that extends along the length of the housing 24 to enhance its stability. The thickness of strut 44 is selected commensurate with the lateral strength needed to prevent bending during operation and rigidly support the housing 24.

Figure 5:
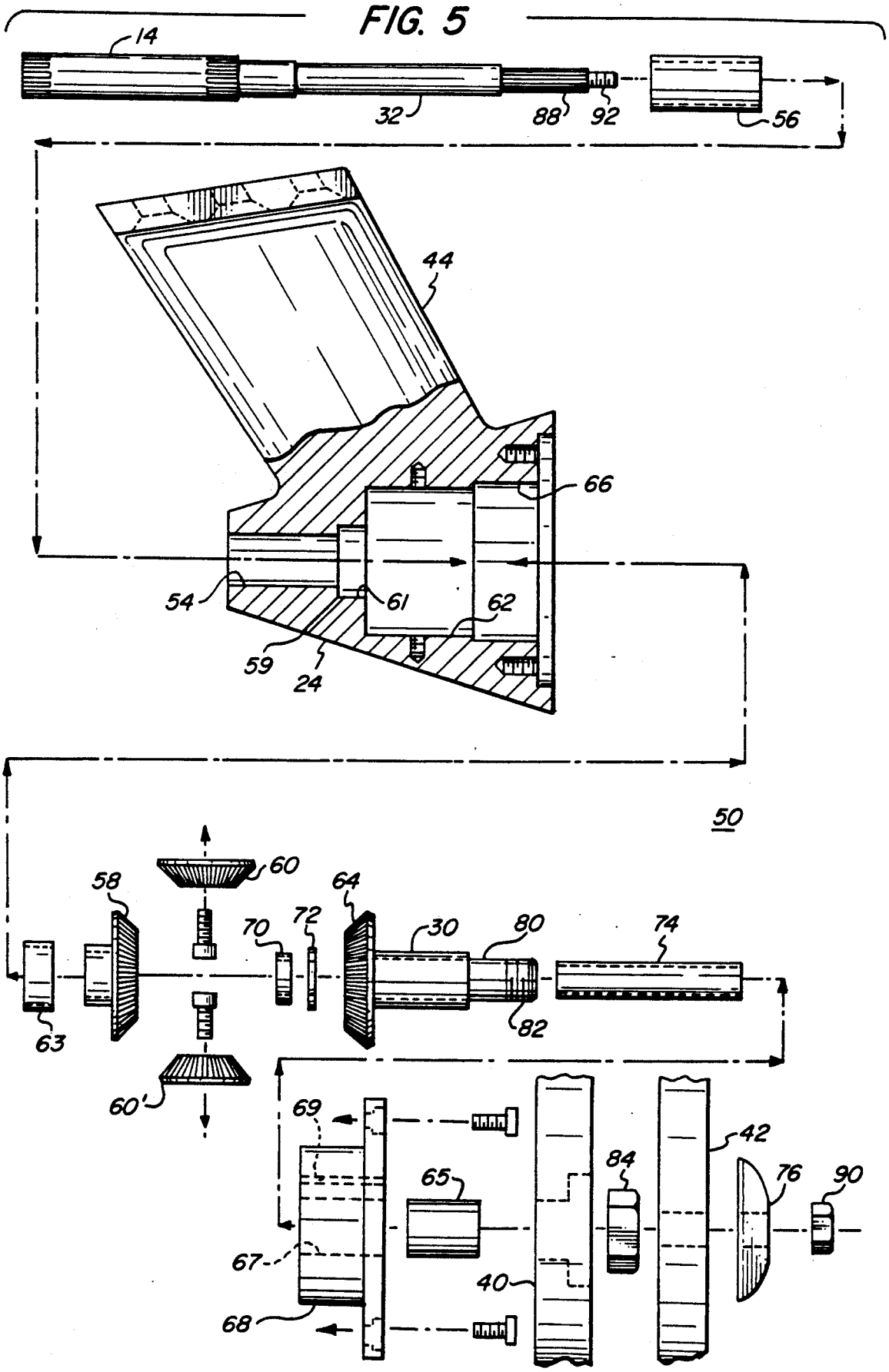
FIG. 5 is a telescopic view of the components used in the propeller structure of FIG. 4.

The propeller structure 23 and its housing 24 in particular contains, as shown in FIGS. 4 and 5, a mechanism 50 for converting the input power available from drive shaft 14 into counter-rotating propeller shafts 30, 32. The mechanism 50 may comprise a gear system such as illustrated in U.S. Pat. No. 1,482,381.

Thus, housing 24 has a bore 54 (FIG. 5) which includes a suitable cutlass bearing 56 (FIG. 4) that supports drive shaft 14. Shaft 14 carries a bevel gear 58 which drives a pair of bevel idlers 60, 60' that are rotatably-mounted in a counterbore 62 with bearings such as 61. A forward bearing 63 is press-fitted onto shaft 14 and holds gear 58 in place. Bearing 63 fits into a counterbore 61. A water passage 59 is provided to enable water to pass directly through housing 24 onto bearing 63 for its lubrication. The idler or intermediate gears 60, 60' drive an output bevel gear 64 that is mounted on output shaft 30.

The drive shaft 14 is coupled through housing 24 to operatively engage hub 42 of the aft-located propeller 36. A cutlass bearing 65 is press fit into bore 67 of a cap 68 that acts as a cover plate for the mechanism inside housing 24. Bearing 65 is operatively located between outer hollow propeller shaft 30 and cap 68 and provides stable, low vibration support for shaft 30 near propeller 34 close to housing end 28.

The plate 68 fits into counter bore 66 of housing 24 and is provided with a passage 69 through which water can move after lubricating the mechanism 50. Water also moves through the various cutlass bearings as is well known in the art. A thrust bearing 70 is mounted on shaft 14 and, with an interposed washer 72, prevents the hollow outer shaft 30 from moving forward when under load. A cutlass bearing 74 is located between the hollow propeller shaft 30 and solid propeller shaft 32 to prevent the latter from vibrating. The bearing 74 has a length that is generally commensurate with the overlap between the inner and outer propeller shafts 30, 32. An end cap 76 is used to lock the aft propeller 36 into place.

Suitable splines are used between the propellers 34, 36 and their respective mounting shafts to provide positive non-slip driving of the propellers. A splined connection is also made between drive shaft 14 and bevel gear 58. Forward propeller 34 has a splined or keyed engagement with the splines 80 of hollow propeller shaft 30. The latter has a threaded end 82 onto which a nut 84 is screwed. A suitable counterbore 86 is used to receive nut 84.

The mounting of propeller 36 to propeller shaft 14 is done by employing suitable interconnecting splines 88 with axially-aligned spline slots and a lock nut 90 that is screwed onto the threaded end of hollow shaft 30. The various parts used to make the conversion mechanism, the housing and other parts are preferably formed of the same material that enables water lubrication with high resistance to salt water corrosion. Stainless steel can be used.

Having thus described a preferred embodiment of the invention, its advantages can be appreciated. Variations from the invention can be contemplated without departing from the scope of the invention.

What is claimed is:

1. A counter-rotating propeller system for boats having an inboard engine which rotates a drive shaft that extends in an aft direction through a lower part of the boat hull, comprising:

first and second propellers, each of said propellers having a hub;

coaxially-mounted inner and outer propeller shafts, each shaft having a said propeller mounted at an aft end and with the inner propeller shaft being coupled in axial alignment to the drive shaft externally of the boat hull;

conversion means located externally to the boat hull and coupled in interlocked relationship to the inner propeller shaft for converting drive shaft rotation to counter rotation of the inner and outer propeller shafts;

a housing enclosing the conversion means, said housing having a forward open end through which said inner propeller shaft extends for coupling to the drive shaft and having an aft end from which the coaxial propeller shafts extend; and a strut connected to the lower part of the boat hull and to the housing, the strut being sufficiently sized and shaped to rigidly support the housing while maintaining proper alignment of the conversion means with the drive shaft to reduce lateral vibrations, said strut further having a lateral crossectional area selected to present a streamlined shape to the flow of water while extending sufficiently longitudinally to rigidly support the housing.

2. The counter-rotating propeller system as claimed in claim 1 and further comprising:

a thrust bearing operatively placed with respect to the outer propeller shaft to restrict its forward motion under load.

3. The counter-rotating propeller system as claimed in claim 1 and further including a bearing interposed between the inner and outer propeller shafts.

4. The counter-rotating propeller system as claimed in claim 3 wherein the bearing extends longitudinally for a distance generally commensurate with the distance along which the inner and outer propeller shafts extend.

5. The counter-rotating propeller system as claimed in claim 4 wherein the bearing is a cutlass bearing.

6. The counter-rotating propeller system as claimed in claim 5 and further including a second cutlass bearing operatively interposed between the drive shaft and the housing.

7. The counter-rotating propeller system as claimed in claim 6 and further comprising a bearing interposed between the outer propeller shaft and the housing.

8. The counter-rotating propeller system as claimed in claim 1 wherein the housing has a generally frustoconical shape.

9. The counter-rotating propeller system as claimed in claim 8 wherein the aft end of the housing has a diameter that is sized commensurate with that of the propeller hubs.

10. The counter-rotating propeller system as claimed in claim 9 wherein the housing has a counter bore and said conversion means comprises a plurality of interconnected bevel gears that are mounted in the housing counter bore.

* * * * *